US006446442B1

(12) United States Patent
Batchelor et al.

(10) Patent No.: US 6,446,442 B1
(45) Date of Patent: Sep. 10, 2002

(54) HEAT EXCHANGER FOR AN ELECTRONIC HEAT PUMP

(75) Inventors: Andrew W. Batchelor, Joondalup; Ben Banney, Victoria Park; David McDonald, Kallaroo; Tilak T. Chandratilleke, Mount Claremont, all of (AU)

(73) Assignee: Hydrocool Pty Limited, Fremantle (AU)

( * ) Notice: Subject to any disclaimer, the term of this patent is extended or adjusted under 35 U.S.C. 154(b) by 0 days.

(21) Appl. No.: 09/857,668

(22) PCT Filed: Oct. 6, 2000

(86) PCT No.: PCT/AU00/01220

§ 371 (c)(1),
(2), (4) Date: Jul. 31, 2001

(87) PCT Pub. No.: WO01/25711

PCT Pub. Date: Apr. 12, 2001

(30) Foreign Application Priority Data

Oct. 7, 1999 (AU) ..... PO3321

(51) Int. Cl.[7] ..... F25B 21/02
(52) U.S. Cl. ..... 62/3.3; 62/3.2; 62/259.2
(58) Field of Search ..... 62/3.3, 3.2, 259.2

(56) References Cited

U.S. PATENT DOCUMENTS

| | | | | | |
|---|---|---|---|---|---|
| 4,400,948 | A | * | 8/1983 | Moorehead | 62/3 |
| 4,402,185 | A | * | 9/1983 | Perchak | 62/3 |
| 5,092,129 | A | * | 3/1992 | Bayes et al. | 62/3.3 |
| 5,304,846 | A | | 4/1994 | Azar et al. | 257/722 |
| 5,448,449 | A | | 9/1995 | Bright et al. | 361/704 |
| 5,465,581 | A | * | 11/1995 | Haertl et al. | 62/50.1 |
| 5,471,850 | A | * | 12/1995 | Cowans | 62/223 |
| 5,584,183 | A | | 12/1996 | Wright et al. | 62/3.7 |
| 5,653,111 | A | * | 8/1997 | Attey et al. | 62/3.7 |
| 5,715,684 | A | | 2/1998 | Watanabe et al. | 62/3.2 |
| 5,822,993 | A | | 10/1998 | Attey | 62/3.7 |
| 5,823,005 | A | * | 10/1998 | Alexander et al. | 62/259.2 |
| 6,031,751 | A | * | 2/2000 | Janko | 363/144 |
| 6,076,357 | A | * | 6/2000 | Holdren et al. | 62/3.2 |
| 6,226,178 | B1 | * | 5/2001 | Broder et al. | 361/687 |
| 6,279,337 | B1 | * | 8/2001 | Davidson et al. | 62/259.2 |

FOREIGN PATENT DOCUMENTS

| | | |
|---|---|---|
| DE | 39 37 017 A1 | 5/1991 |
| WO | 94/23449 | 10/1994 |

* cited by examiner

*Primary Examiner*—William C. Doerrler
*Assistant Examiner*—Mark Shulman
(74) *Attorney, Agent, or Firm*—Woodcock Washburn LLP

(57) ABSTRACT

A heat exchanger 17 for an electronic heat pump 11 includes a thermally conductive base plate 18 having first and second surfaces, the first surface being flat and adapted to make intimate surface contact with a surface of the electronic heat pump and the second surface being obverse to the first surface and supporting an array of thermally conductive fins 21. The adjacent fins 21 define there between a plurality of micro channels.

17 Claims, 14 Drawing Sheets

| LEVEL | T |
|---|---|
| 6 | 303.7 |
| 5 | 303.2 |
| 4 | 302.8 |
| 3 | 302.3 |
| 2 | 301.8 |
| 1 | 301.3 |

T DENOTES TEMPERATURE IN DEGREES KELVIN

| LEVEL | T |
|---|---|
| 20 | 354.0 |
| 19 | 350.8 |
| 18 | 347.6 |
| 17 | 344.4 |
| 16 | 341.2 |
| 15 | 338.0 |
| 14 | 334.8 |
| 13 | 331.6 |
| 12 | 328.4 |
| 11 | 325.2 |
| 10 | 322.0 |
| 9 | 318.8 |
| 8 | 315.6 |
| 7 | 312.4 |
| 6 | 309.2 |
| 5 | 306.0 |
| 4 | 303.2 |
| 3 | 301.1 |
| 2 | 300.1 |
| 1 | 300.0 |

T DENOTES TEMPERATURE IN DEGREES KELVIN

HEAT EXCHANGER FOR AN ELECTRONIC HEAT PUMP

TECHNICAL FIELD

This invention relates to electronic heat pumps and finned heat exchangers for transferring heat to and from such heat pumps.

For the sake of convenience, the invention will be described in relation to an electronic heat pump for a refrigeration system, but, it is to be understood that the invention is not limited thereto.

An electronic heat pump is defined herein as any heat pump or refrigerating module that directly depends upon flow of electrons and/or energy changes of electrons for its operation. This definition includes, but is not limited to, thermo-electric heat pumps and thermionic heat pumps.

BACKGROUND ART

The economic viability of a refrigeration system, which is based on the principles of a electronic heat pump, is primarily dependent on the efficiency of heat exchange between the electronic heat pump and two or more heat exchangers that collect and release the thermal load of refrigeration.

In a refrigeration system, heat can be dissipated effectively to the ambient air with the use of liquid coolants and radiators. However, the overall performance of a cooling system operating on an electronic heat pump is constrained by the heat transfer mechanism to the coolant fluid employed by the electronic heat pump.

In the prior art system disclosed in U.S. Pat. No. 5,715,684, effective heat transfer is achieved by directing jets of liquid onto the face of the thermoelectric module.

According to one aspect of the invention there is provided a heat exchanger for an electronic heat pump comprising:

a thermally conductive base plate having first and second surfaces;

the first surface being flat and adapted to make intimate surface contact with a surface of an electronic heat pump the second surface being obverse to the first surface and supporting an array of thermally conductive fins, adjacent fins defining there between a plurality of channels.

In another prior art design, streams of coolant are forced to flow along a series of channels over the face of the electronic heat pump—see U.S. Pat. Nos. 5,653,111 and 5,822,993.

Both of these designs offer limitations in terms of heat transfer capacity where the area available for heat dissipation to coolant is restricted to the face area of the electronic heat pump. In addition, fluid flow passages in Attey were made from non-conductive materials and no provision was made to incorporate additional heat flow paths to the coolant.

It is, therefore, an object of the present invention to extend the area of convective heat transfer between the electronic heat pump and coolant to a size significantly greater than the available area on the surface of the electronic heat pump.

SUMMARY OF INVENTION

According to another aspect of the invention there is provided a heat exchanger for one side of an electronic heat pump having a cold side and a hot side, said heat exchanger comprising:

(i) a heat exchanger having a thermally conductive base plate adapted to be thermally coupled by one face to one side of the electronic heat pump and having a plurality of spaced apart thermally conductive heat exchanger fins projecting outwardly from the other face, adjacent fins defining channels there between, and (ii) a manifold having a recess for receiving the finned base plate and the backing plate, a fluid inlet to the recess and a fluid outlet from the recess.

According to another aspect of the invention there is provided an electronic heat pump and heat exchanger system comprising:

(i) an electronic heat pump having a hot side and a cold side, (ii) a heat exchanger as defined above on at least one side of the electronic heat pump, and (iii) means connecting the manifolds and adapted to provide a compressive sealing force between each base plate and the respective hot side and cold side of the electronic heat pump.

In one form of the invention, the thermally conductive base plate is integral with the fins.

The base plate of the heat exchanger may be joined to the face of the heat pump using soft solder with low melting point and good thermal conductivity such as Indium. Low melting point helps to carry out the process of fusing the base plate to the electronic heat pump with minimum thermal damage while, high thermal conductivity facilitates low thermal contact resistance at the joined interface.

A practical advantage of the invention is that, the geometrical arrangement of the heat exchanger enables the use of heat pump face area in its entirety in the heat dissipation process to the fluid. In previous designs, participating heat transfer surfaces of the electronic heat pump were obstructed by mechanical components such as seals, which lead to unsatisfactory operation of the peripheral parts of the electronic heat pump.

One aspect of the present invention relates to the application of a finned heat exchanger in a device which utilises an electronic heat pump to generate a thermal gradient. A microchannel between a pair of adjacent fins is defined as a channel whose width is approximately 0.1 to 5 mm and preferably about 0.4 mm. In a preferred embodiment, the fins which define the height of the microchannel are about 3.6 mm high and having a thickness of about 0.8 mm.

MODES FOR CARRYING OUT THE INVENTION

Figure 1:
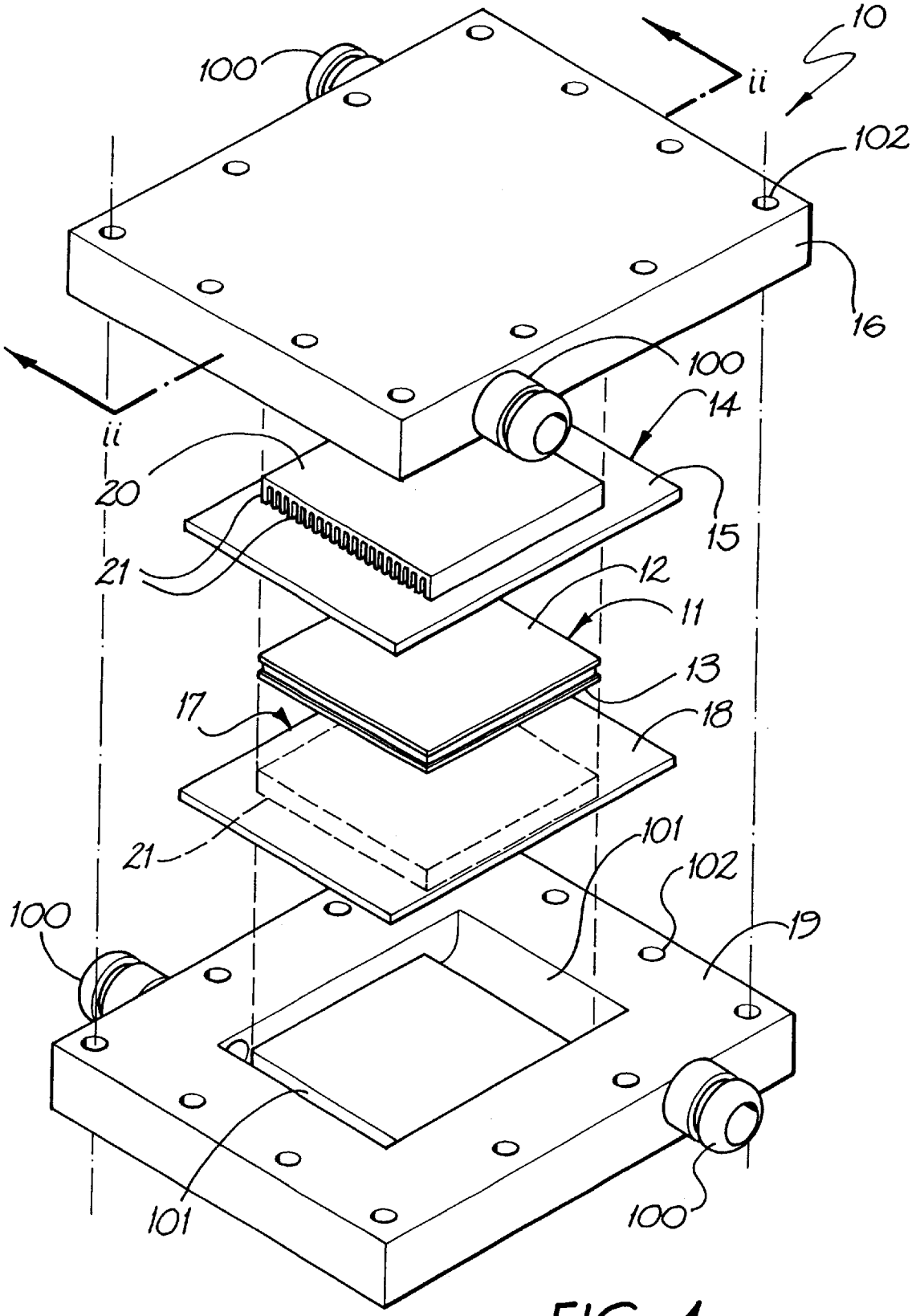
FIG. 1 is an exploded view of a heat pump and manifold assembly incorporating a finned heat exchanger according to one embodiment of the invention.
Figure 2:
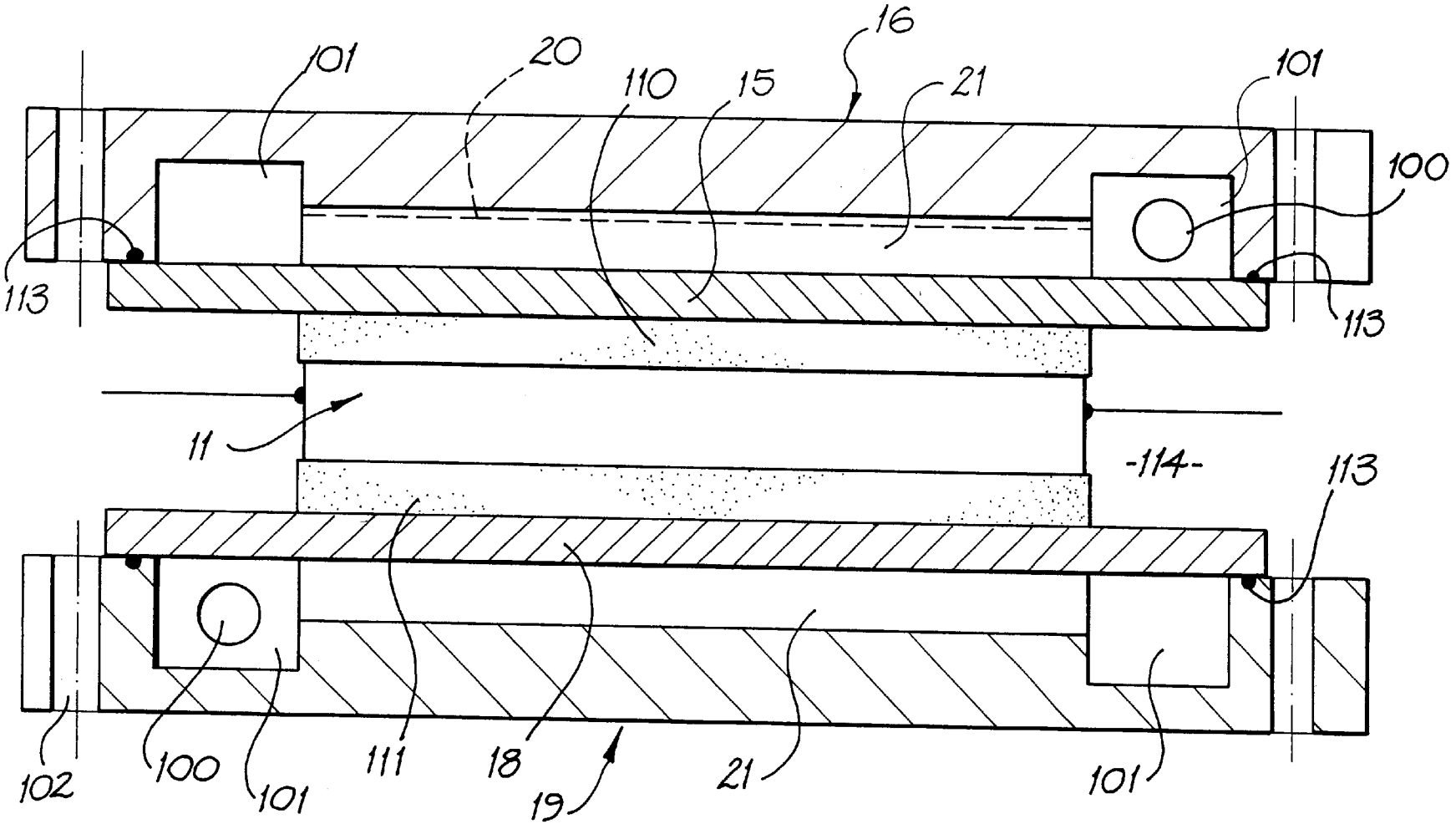
FIG. 2 is a cross-sectional view taken along lines ii—ii of FIG. 1 (when assembled)

Referring to FIGS. 1 and 2, the heat transfer system 10 according to this embodiment of the invention includes an electronic heat pump 11 having, in this instance, an upper cold side 12 and a lower hot side 13, a cold side finned heat exchanger 14 including a cold side backing plate 15 and a cold side manifold 16. On the hot side of the electronic heat pump 1 there is a hot side finned heat exchanger 17 including a hot side backing plate 18 and a hot side manifold 19.

The finned heat exchangers 14 and 17 each consist of a flat base plate 15 integral with or joined to a plurality of parallel equally spaced fins 21.

In order for the system to function, a liquid coolant is passed through the channels between the fins of the heat exchanger 17. Heat is then transferred away from the "hot side" of the thermoelectric module by conduction through the coolant in the heat exchanger channels and from the surface of the heat exchanger, conduction through the heat exchanger 17 and through the solder or other jointing compound fixing the heat exchanger 17 to the adjacent surface of the thermoelectric module 11. Heat is transferred through the thermoelectric module 11 in its normal manner. The second heat exchanger 14 may or may not be attached to the "cold side" of the thermoelectric module and operates in a similar fashion to the heat exchanger on the "hot side" but with the direction of heat flow reversed.

The respective orientation of the cold side and hot side are controlled by the electrical polarity of the electronic heat pump.

The dimensions of the system are based on the dimensions of the electronic heat pump 11, which is determined by its manufacturer.

In one configuration the heat exchanger 14, 17 consists of a flat base plate 15, 18 joined to a plurality of axially aligned, equally spaced fins, enclosed by a flat plate (e.g. 20) across the top of the fins. In another configuration the flat plate across the top of the fins is integral with the fins, forming channels surrounded by homogenous parent metal. The number of fins, the dimensions of the fins, the dimensions of the space between the fins are optimised by numerical analysis of flow and heat transfer to ensure the most efficient convection for a minimum of flow resistance. The cross-sectional shape of the fins may be further optimised from the simple rectangular shape to a more complex shape such as a trapezium to further heat transfer or to facilitate manufacture.

The surface of the base plate of the heat exchanger in contact with the heat pump is manufactured to sufficient flatness to ensure good thermal contact with the electronic heat pump. The heat exchanger is made of a material with high thermal conductivity, is mechanically robust and resistant to corrosive damage by the coolant.

Each manifold 16 and 19 has the following functions, (a) an enclosure to receive and discharge the coolant, via ports 100, from an attached pipe, (b) a flow distributor to evenly distribute flow of coolant between the adjacent fins of the heat exchanger 14 or 17, (c) a structure to allow clamping forces between the heat exchangers and the electronic heat pump 11. To serve function (a) each manifold is fitted with an entry and exit port 100 for fluid, the entry and exit ports are located at opposite ends of a diagonal that is drawn across the rectangular cross section of the cover. The purpose of this orientation is to ensure even distribution of flow to the fins, according to an earlier established principle as discussed in U.S. Pat. No. 5,653,111.

Adjacent to the exit and entry ports, there is a cavity 101 running from the port to at least the furthest fin. The purpose of the cavity 101 is to ensure an even distribution of flow from the port to the fins of the heat exchanger 14 and 17. Each manifold may be fitted with an equally spaced series of bolt-holes 102 running around the periphery of the cover. This allows provision of bolts and nuts to impose the said clamping force.

As shown in FIG. 2, the electronic heat pump 11 is sandwiched between the two heat exchangers. In the instance of a Peltier cell, the ceramic exterior faces 110, 111 are in close contact with the base plates 15, 18 of the heat exchangers. The base plates 15, 18 are restrained by their side edges soldered to a metallized surface on the ceramic faces 110, 111 and may be sealed against the interior surface 112 of the manifolds 16, 19. O-ring seals 113 may be used to prevent leakage of fluid from the channels 101 into the central area 114 containing the heat pump 1. As further illustrated in FIG. 2, the ports 100 lead into channels 101 which extend at least the full length of the array of fins 21. The distal edges of the fins or alternatively, the plate or surface 20 which encloses them is in contact with the interior surface of the manifold 16, 19.

FIG. 2 illustrates two distinct styles of heat exchanger fabrication. The upper or cold side heat exchanger comprises an array of fins 21 and the base plate 15. In this example, the array of fins and channels 21 include a covering plate 20 which may be integral with the fins or soldered onto the array of fins. It is this covering plate 20 which is in contact with and sealed against the manifold 16 so that fluid flow between the channels 101 occurs only through the array of fins 21. Where manufacturing tolerances can be controlled, and as shown in the lower half of FIG. 2, the array of fins 21 may be open ended, with the distal tips of the fins contacting and sealing against the floor of the manifold 19. A third variation is depicted in FIG. 3.

Figure 3:
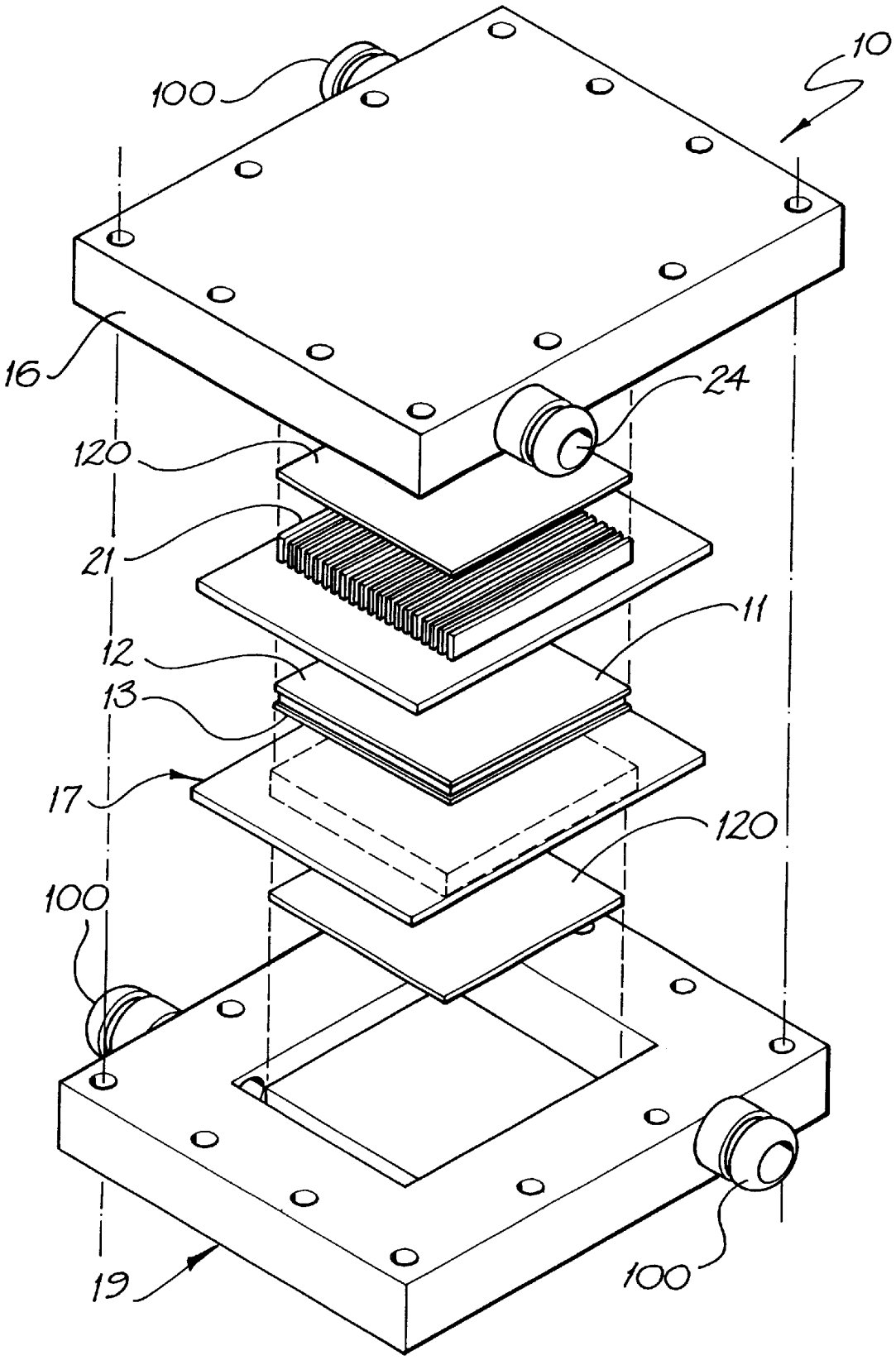
FIG. 3 is an exploded view of a modified form of the heat pump and manifold assembly shown in FIG. 1.

FIG. 3 illustrates a resilient polymeric sheet 120 interposed between one or both heat exchangers and their respective manifolds 16, 19. These polymeric or soft metal sheets 120 may be used to ensure a proper resilient seal between an array of fins and its manifold when the manifolds are joined together. If effect, the sheets 120 are capable of taking up manufacturing tolerances, or in the case where open ended fins are used (as shown in FIG. 3) actually serve to seal the channels between fins against the inner surface of the manifold.

Figure 4:
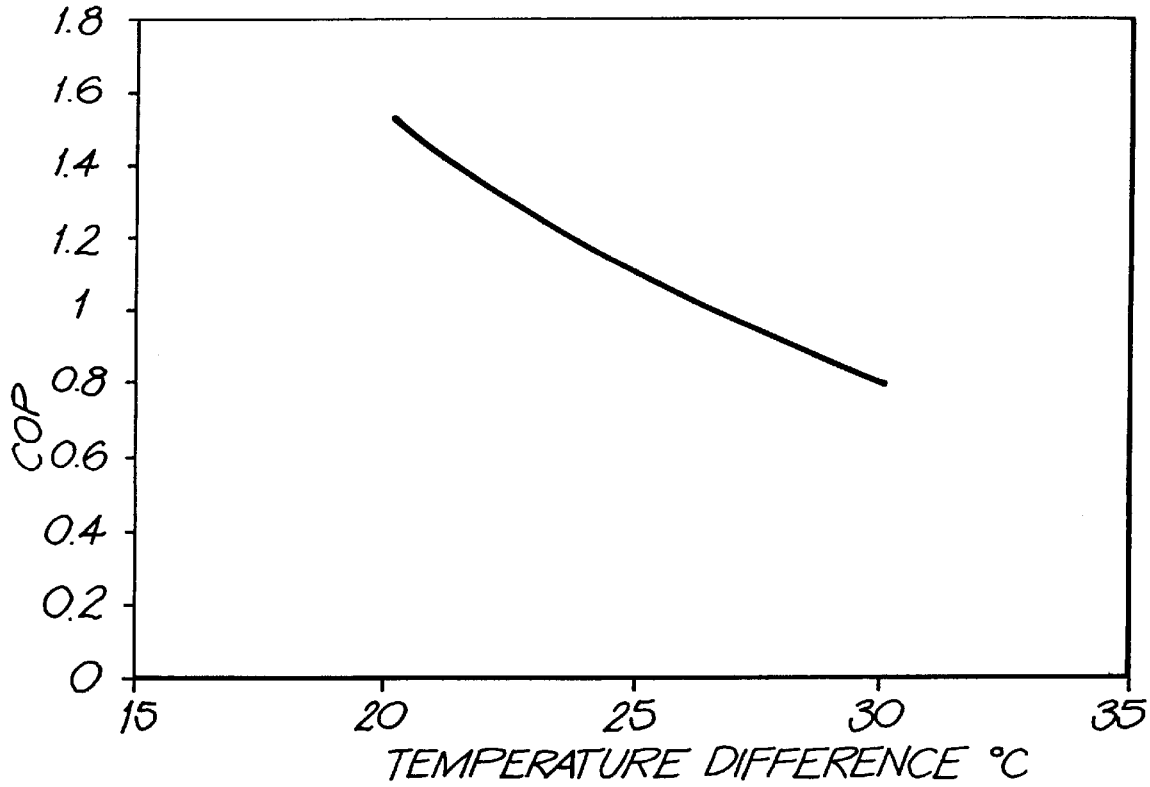
FIG. 4 is a graph of the coefficient of performance against temperature difference for a thermoelectric heat pump.

The efficiency of a heat pump such as a thermoelectric device is critically dependent on the temperature difference between the hot side and the cold side. FIG. 4 shows a graph of COP (coefficient of performance) vs del T for a typical thermoelectric module (Frost 76S from Kryotherm).

Figure 5:
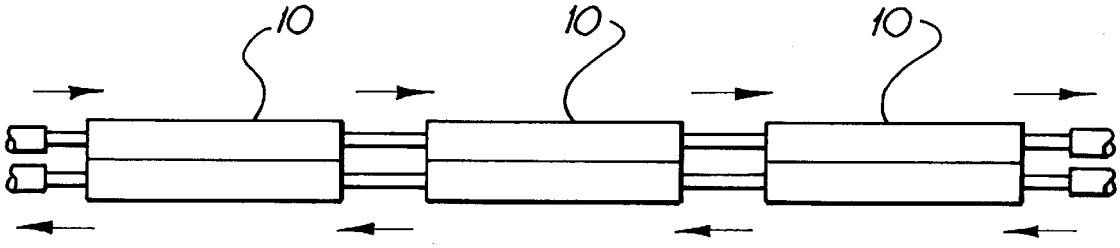
FIG. 5 is a schematic diagram of a plurality of the heat pump and manifold assemblies shown in FIG. 1 connected in series, FIG. 6. is a schematic diagram of a plurality of the heat pump and manifold assemblies shown in FIG. 1 connected in parallel.
Figure 6:
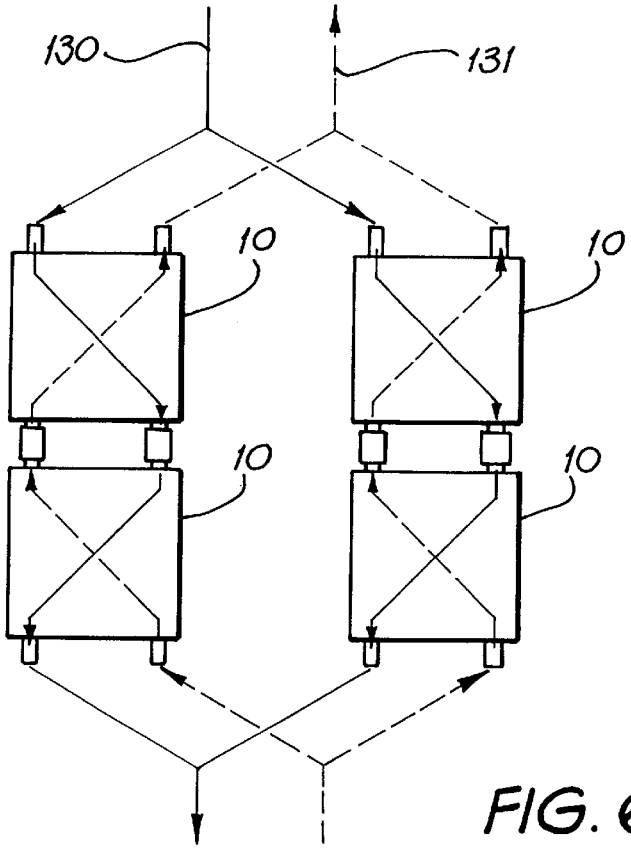

FIGS. 5 and 6 show a series and a parallel arrangement of heat exchanger 'units' to obtain a larger refrigerating power than can be achieved with a single heat exchanger and enclosed electronic heat pump. FIG. 5 illustrates a series arrangement of devices 10 of the type depicted in FIG. 1. It would be appreciated that by fluidly connecting adjacent devices 10 in a counter-current arrangement can result in the ability to accommodate greater thermal loads for a given rate of fluid flow. In this example, the hot side of the device 10 is connected to the hot side of an adjacent device, the flows of hot and cold liquids travelling in opposite directions as illustrated. FIG. 6 illustrates the parallel connection of two pairs of devices 10, each pair operating in series. Again, the flows of hot and cold liquids are travelling in opposite directions to maximise thermal efficiency. The hot side fluid flows 130 are depicted as a solid line while the cold side fluid flows are illustrated with a dash line 131.

Figure 7:
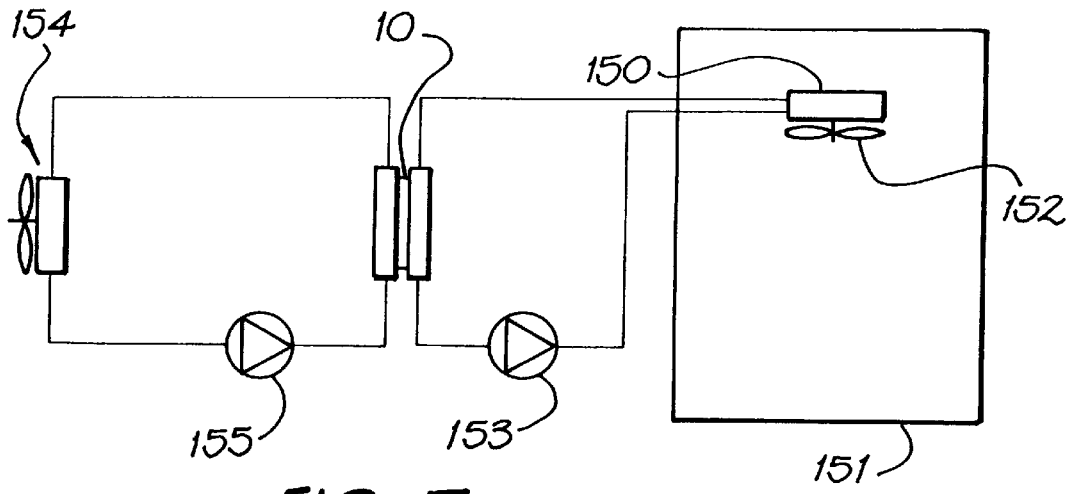
FIG. 7 is a schematic diagram of a refrigeration system incorporating the heat pump and manifold assembly of FIG. 1.

FIG. 7 illustrates a schematic system diagram illustrating an application of the device 10 of the present invention. In this example, a cold side heat secondary exchanger 150 is located within a refrigerated space 151. A small fan 152 circulates the air within the refrigerated space in an attempt to achieve thermal equilibrium. The cold side secondary heat exchanger 150 is supplied with cold fluid from the electronic heat pump 10 by a pump 153. The output of the electronic heat pump's hot side manifold is delivered to a secondary hot side fan assisted heat exchanger 154, circulation between the secondary heat exchanger 154 and the heat pump 10 being accomplished by a second pump 155.

Figure 8:
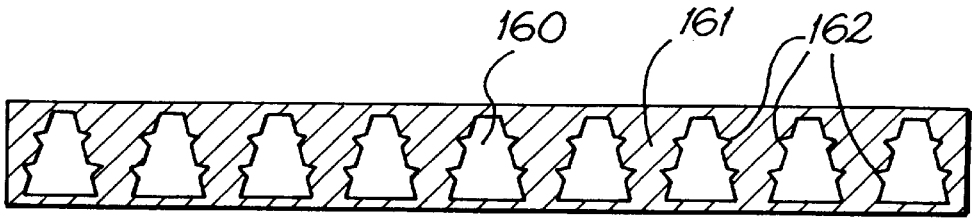
FIG. 8 is a cross-sectional view of fins of a heat exchanger according to another embodiment of the invention.

FIG. 8 illustrates an array of fins 161 which may be used in place of the rectangular fins depicted in, for example, FIGS. 1 and 3. These fins 161 are tapered and include longitudinal grooves 162 which serve to increase the surface area interface between the fins 161 and the channels 160. In this example, the side surfaces of each fin are provided with a pair of "V" shaped grooves which promote heat transfer between the fin 161 and the channel 160. The same effect may be achieved by other forms of convolution of the fins surface or by roughening the surface of the fin.

Figure 9:
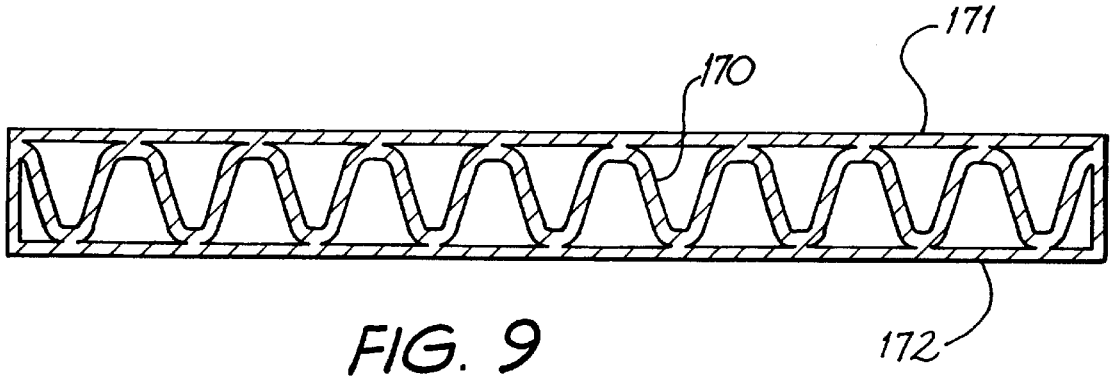
FIG. 9 is a cross-sectional view of fins of a heat exchanger according to another embodiment of the invention.

FIG. 9 illustrates an alternate embodiment of an array of fins wherein the individual fins are replaced by a corrugated metal sheet 170 which is interposed between a pair of parallel sheets or plates 171, 172.

Figure 10:
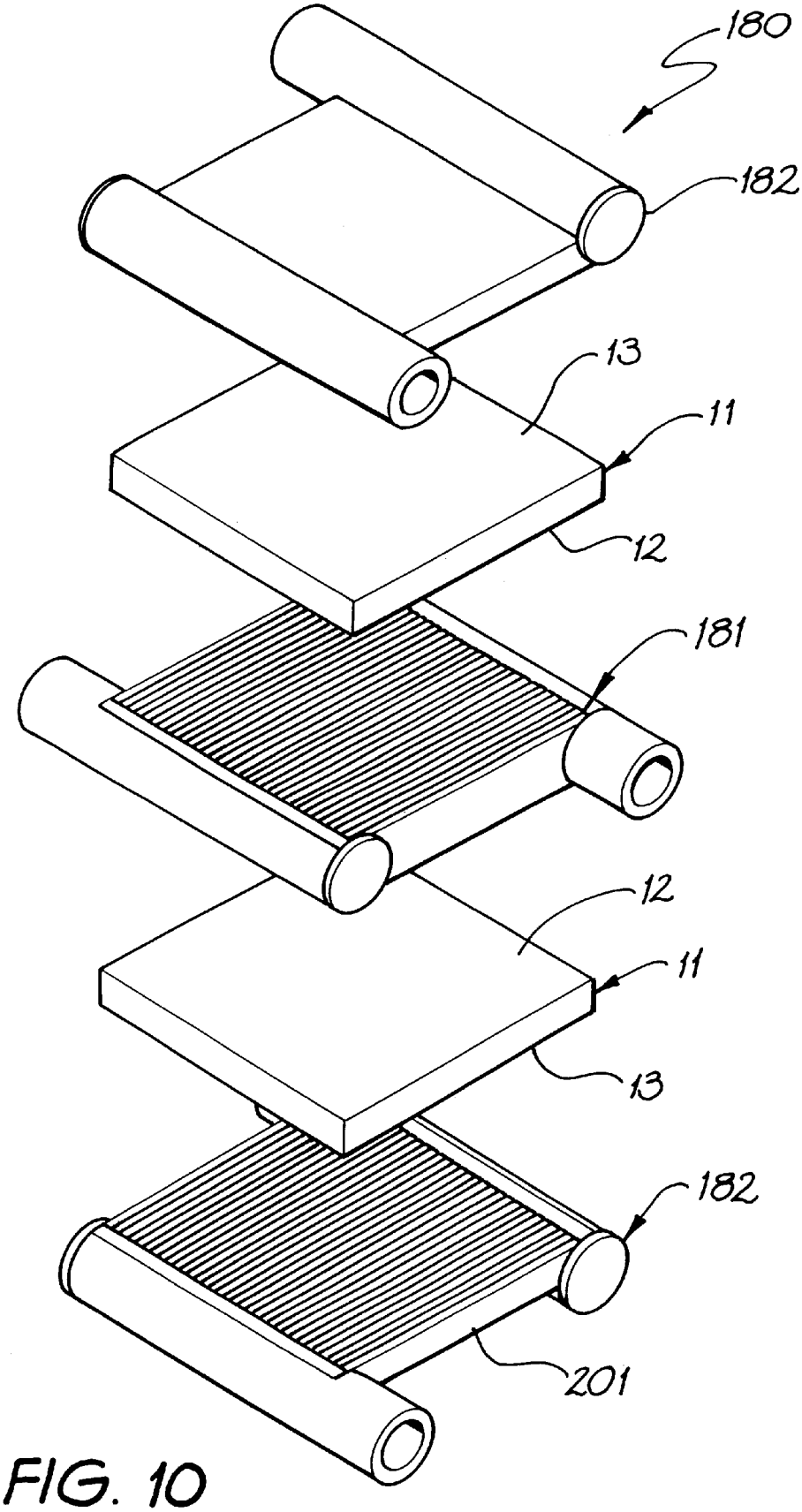
FIG. 10 is an exploded view of a heat pump and manifold assembly incorporating two heat pumps according to another embodiment of the invention.

As shown in FIG. 10, two or more electronic heat pumps 11 may be 5 stacked into a single working module 180. In this example, the cold sides 12 of a pair of heat exchangers 11 are arranged in a facing relationship and separated by a single finned heat exchanger 181. Each hot side 13 of the pair of electronic heat exchangers is associated with its own manifold and heat exchanger 182.

Figure 11:
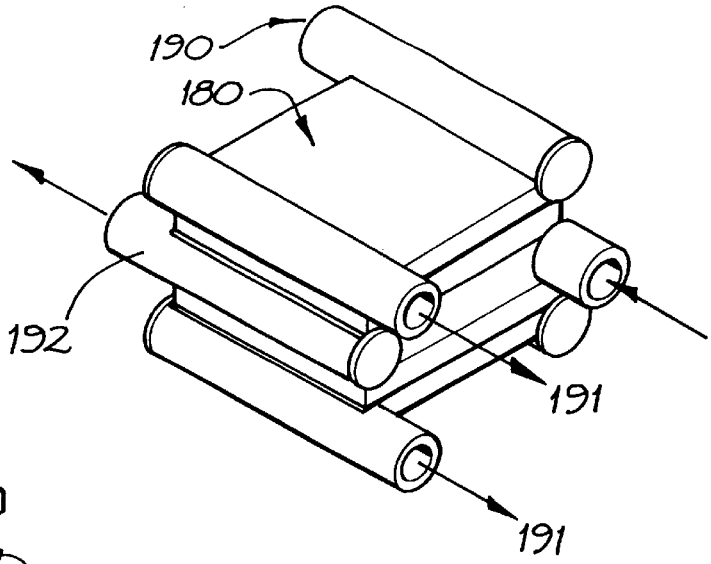
FIG. 11 is a perspective view of the heat pump and manifold assembly shown in FIG. 10.

As shown in FIG. 11, liquid enters the upper and lower manifold entry ports 190 and exits through the hot side ports of the upper and lower manifolds 191. The central manifold and heat exchanger 192 circulates fluid past the cold sides of both of the heat pumps within the module 180.

Figure 12:
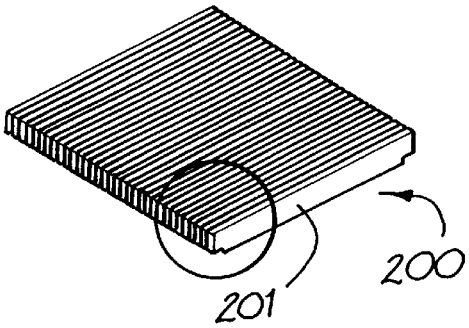
FIG. 12 is a perspective view of one of the heat exchanger fin arrays shown in FIG. 10.
Figure 13:
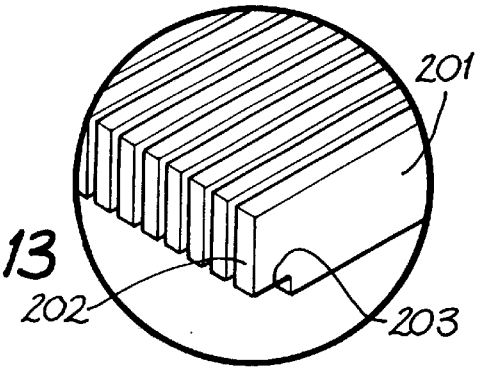
FIG. 13 is an enlarged view of portion of the heat exchanger fin arrays in FIG. 12.

FIG. 12 illustrates an array of fins 200. Each fin 201 is generally rectangular in cross section. Each pair of adjacent fins defines a microchannel there between. As shown in FIG. 13, the ends 202 of each fin 201 may be provided with a step 203 for the purpose of facilitating attachment to the manifold.

Figure 14:
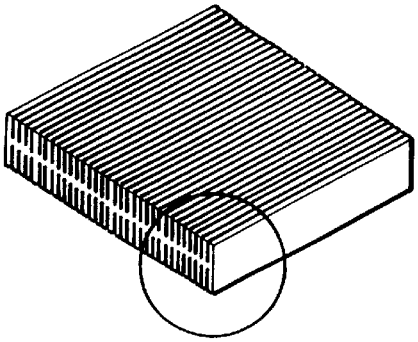
FIG. 14 is a perspective view of the other fin array shown in FIG. 10.
Figure 15:
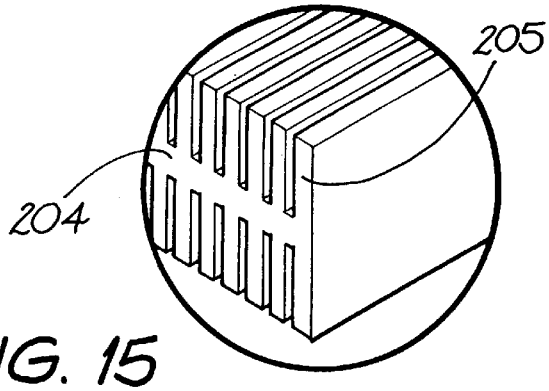
FIG. 15 is an enlarged view of part of the fin array shown in FIG. 14.

FIG. 14 illustrates the type of fin array which is required for the central manifold 181 depicted in FIGS. 10 and 11. As shown in FIG. 15, the array comprises a central web 204 which has similarly configured fins 205 directed outwardly from both its upper and lower surfaces.

The efficiency of the heat pump will be enhanced significantly if the same amount of heat can be pumped from the hot or cold side at a lower temperature difference between the surface of the thermoelectric module and the liquid passing through the heat exchanger. Since heat flow is equal to $h_c \times$Area$\times$del T (where $h_c$ is the heat transfer coefficient), a relatively simple way to reduce del T is to increase Area. The design of the heat exchanger with multiple fins achieves this aim and leads directly to greater heat pump efficiency.

Further, however, there are several other important benefits that the narrow microchannels design confers. It has been found through recent research into the cooling of high heat load computer chips that the usage of microchannels leads to unexpectedly high heat transfer coefficients. The reasons are not yet clear but are believed to include the increased impact of surface tension and electric potential effects which lead to earlier transitions from laminar to turbulent flow. The effects of natural surface roughness are also magnified in microchannel flow and can contribute to the high heat transfer coefficients.

When applied to cooling computer chips, very high heat loads are encountered. Heat fluxes of 75 W/cm$^2$ are now being achieved. Relatively high del T's are required for these heat loads which is in contrast with thermoelectrics. The heat exchanger design exploits the high heat transfer coefficients possible with microchannels and applies the benefit to achieve relatively low heat fluxes (less than 1 W/cm$^2$) at very low del T's. These conditions are ideal for thermoelectric heat pumps and lead to significantly enhanced efficiencies.

Heat transfer in laminar flow is by conduction rather than by convection as is the case in turbulent flow. Because most liquids, including water, have low thermal conductivities this means that heat transfer coefficients are relatively low. The flow in the heat exchangers of this design is in the laminar region and particular attention must then be paid to heat transfer coefficients because of the deleterious effects of high temperature differentials on the thermoelectric module.

A benefit which is exploited in the design is the known feature that the $h_c$ in developing laminar flow is significantly higher than in fully developed laminar flow. The length of channels is controlled to a significant degree by the physical size of the thermoelectric module, typically 40 mm square, and the dimensions of the channels have been optimised within these restrictions so that flow exists predominantly in the developing region.

It is possible to increase the rate of convective heat transfer, without using a finned heat exchanger, by increasing the flow speed of the coolant over the exterior of the electronic heat pump when the flow is in the turbulent region. The heat transfer coefficient is approximately proportional to flow rate when this occurs.

Figure 16:
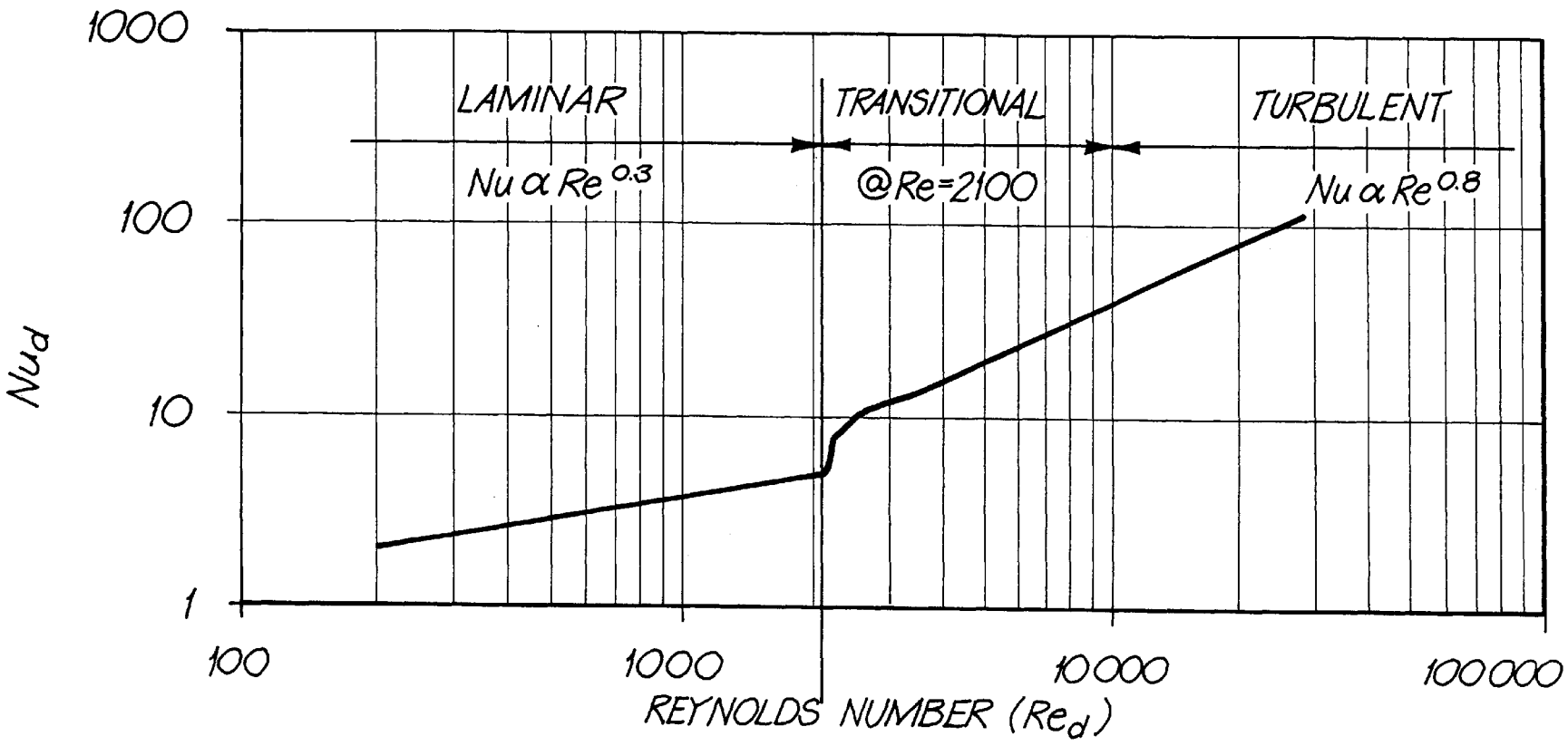
FIG. 16 is a graph of the Nusselt number against Reynolds Number for fully developed flow in a duct.

However, and as shown in FIG. 16, when the flow is laminar, according to the Nusselt equation from the theory of heat transfer in laminar flow, the heat transfer coefficient is related to flow velocity to only the power of 0.3. In other words, increasing flow speed has very little beneficial effect on the heat transfer coefficient. In laminar flow pump power is proportional to the square of the flow rate and therefore if this strategy is adopted it will have a negative impact on overall system efficiency, i.e. the total electric power (including thermoelectric module, pumps and fans) required to pump a given amount of heat will rise.

The adoption of a finned heat exchanger with its increased surface area and improved heat transfer coefficients due to the effect of the microchannels enables more efficient optimisation of the ancillary power consumption of the pumps and fans.

Heat flux from the walls of the channel into the liquid coolant is optimised when all parts of the channel surface are at a uniform temperature. The design of the heat exchanger is such that this is achieved through careful consideration of fin height as well as spacing. The length of the fin is critical because thermal resistance is proportional to fin length. The narrow width of the channel eliminates the situation where the bulk of the fluid passes straight through a heat exchanger with the heat transfer restricted to a relatively thin film of fluid at the surface.

Figure 17:
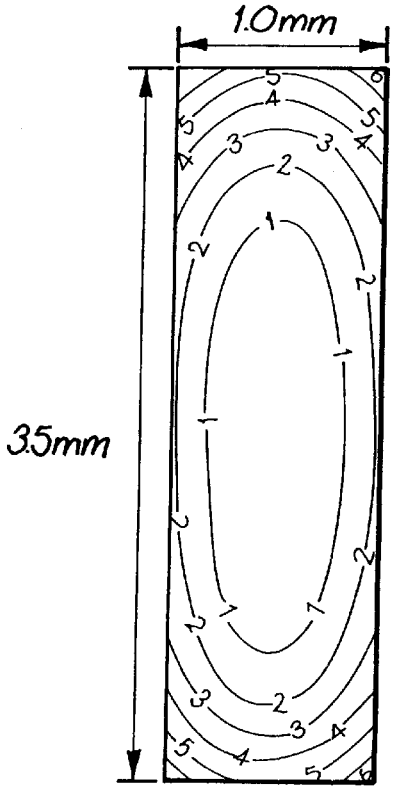
FIG. 17 is a graphical representation of coolant temperature profiles inside a channel of the finned heat exchanger shown in FIG. 1, the channels having a height to width aspect ratio of 3.1:1.

FIG. 17 shows temperature contours within a micro channel of embodiment of a finned conductive heat exchanger having an aspect (i.e. ratio of 1:3.5 height to width) ratio of 3.5:1 on the hot side of a heat pump, the heat flux being 40,000 $W/m^2$, inlet fluid temperature 27° C., flow rate 1 l/min with pure water coolant. These temperature gradients show minor variation (2.4° C.) across the fluid, indicating that all of the fluid is involved in the heat transfer process with little bypass.

Figure 18:
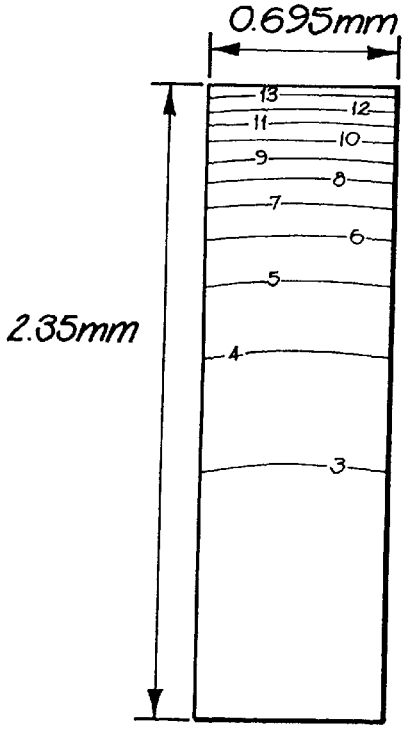
FIG. 18 is a graphical representation of coolant temperature profiles inside the passageway of a prior art manifold.
Figure 19:
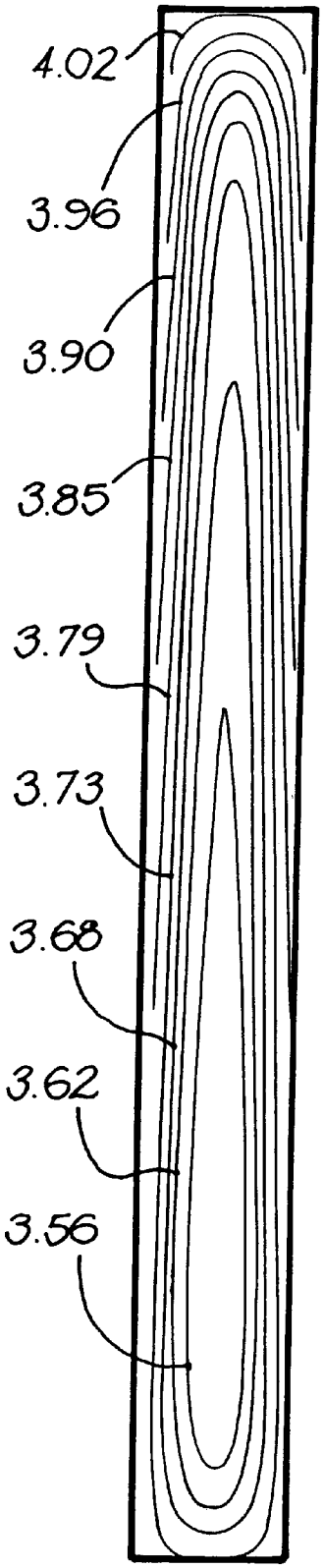
FIG. 19 is a graphical representation of coolant temperature profiles inside a micro channel having an aspect ratio of 10:1.
Figure 20:
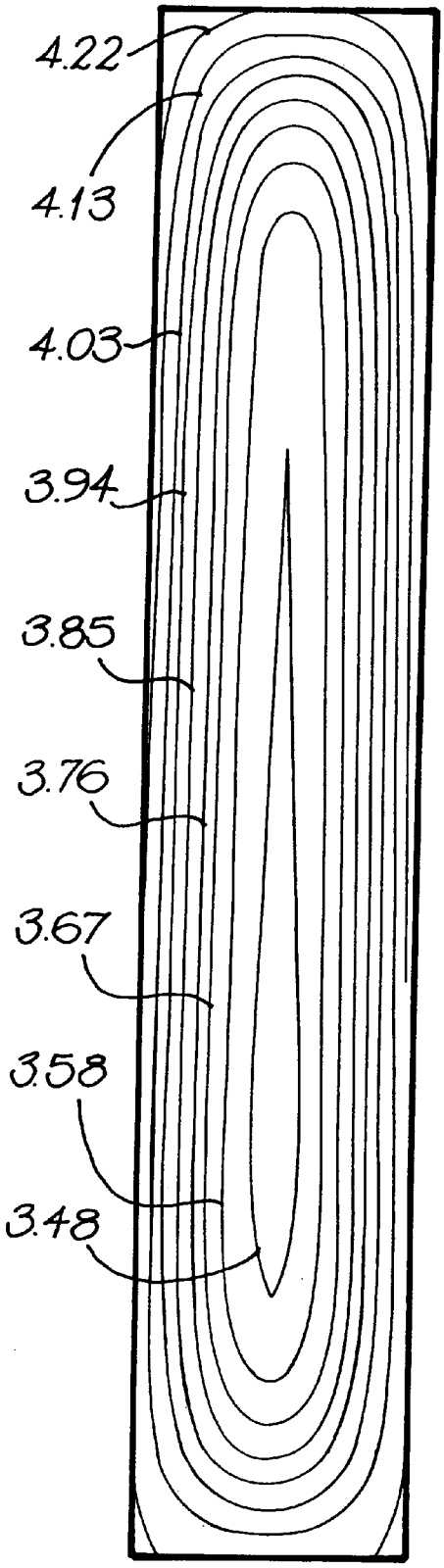
FIG. 20 is a graphical representation of coolant temperature profiles inside a micro channel having an aspect ratio of 6:1.
Figure 21:
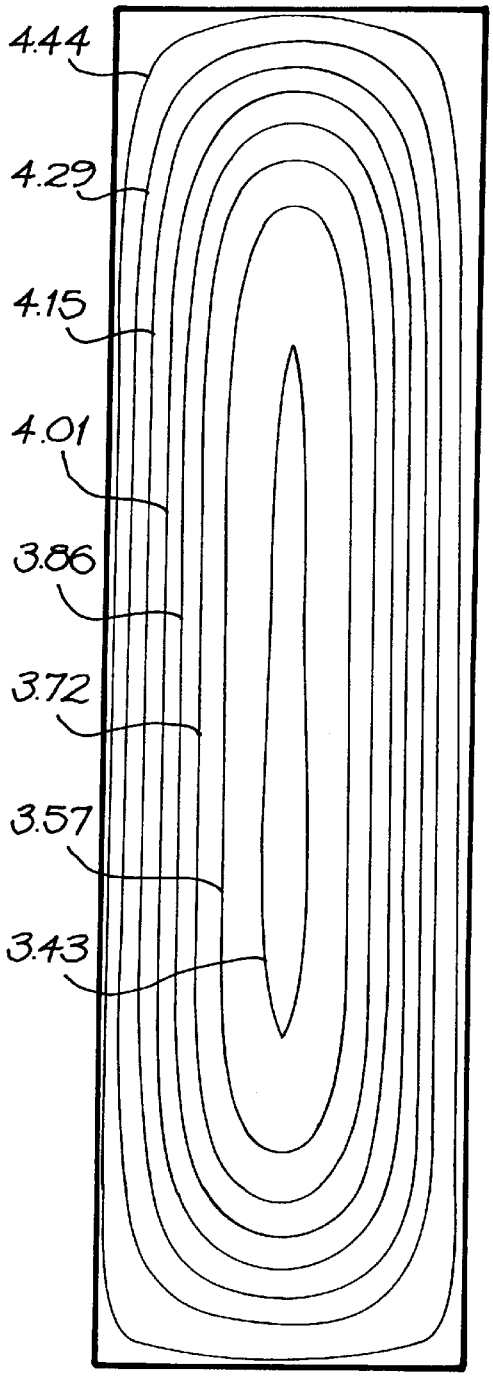
FIG. 21 is a graphical representation of coolant temperature profiles inside a micro channel having an aspect ratio of 4:1.
Figure 22:
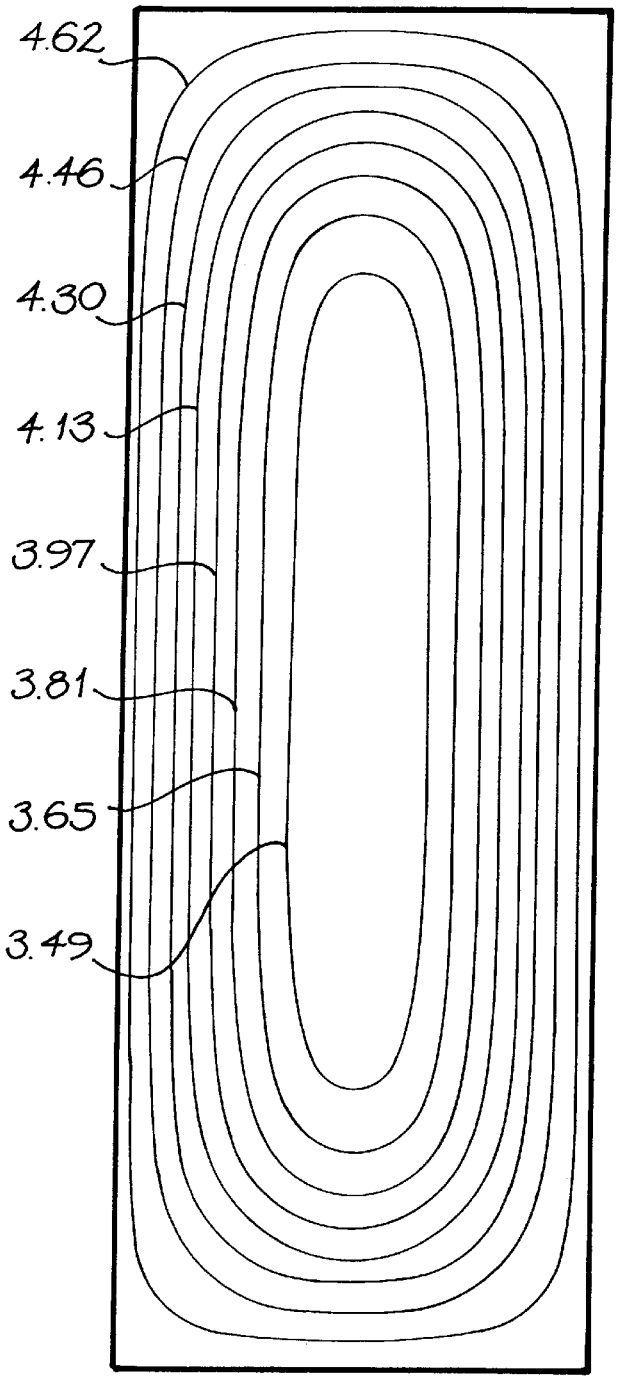
FIG. 22 is a graphical representation of coolant temperature profiles inside a micro channel having an aspect ratio of 3:1.
Figure 23:
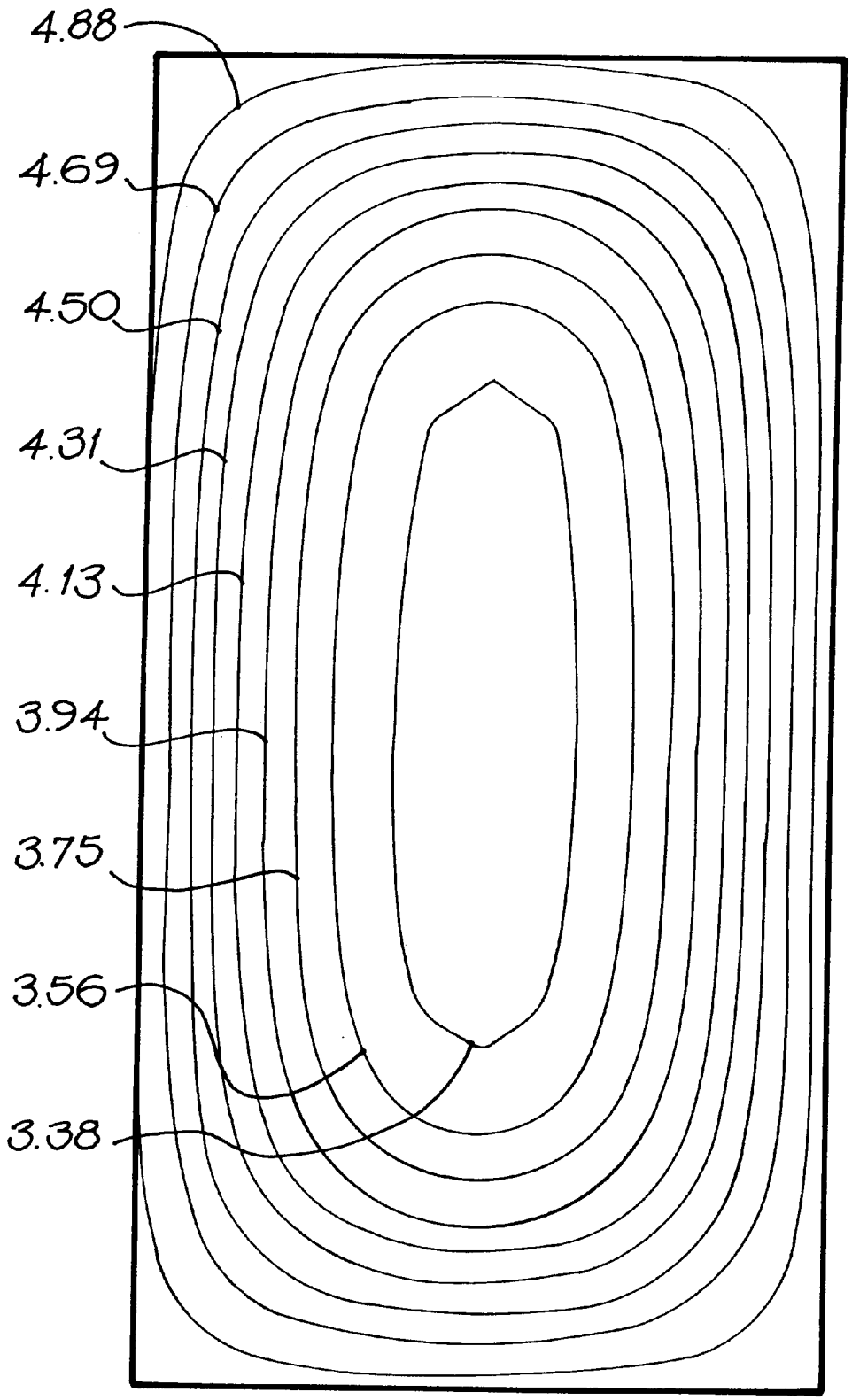
FIG. 23 is a graphical representation of coolant temperature profiles inside a micro channel having an aspect ratio of 2:1.
Figure 24:
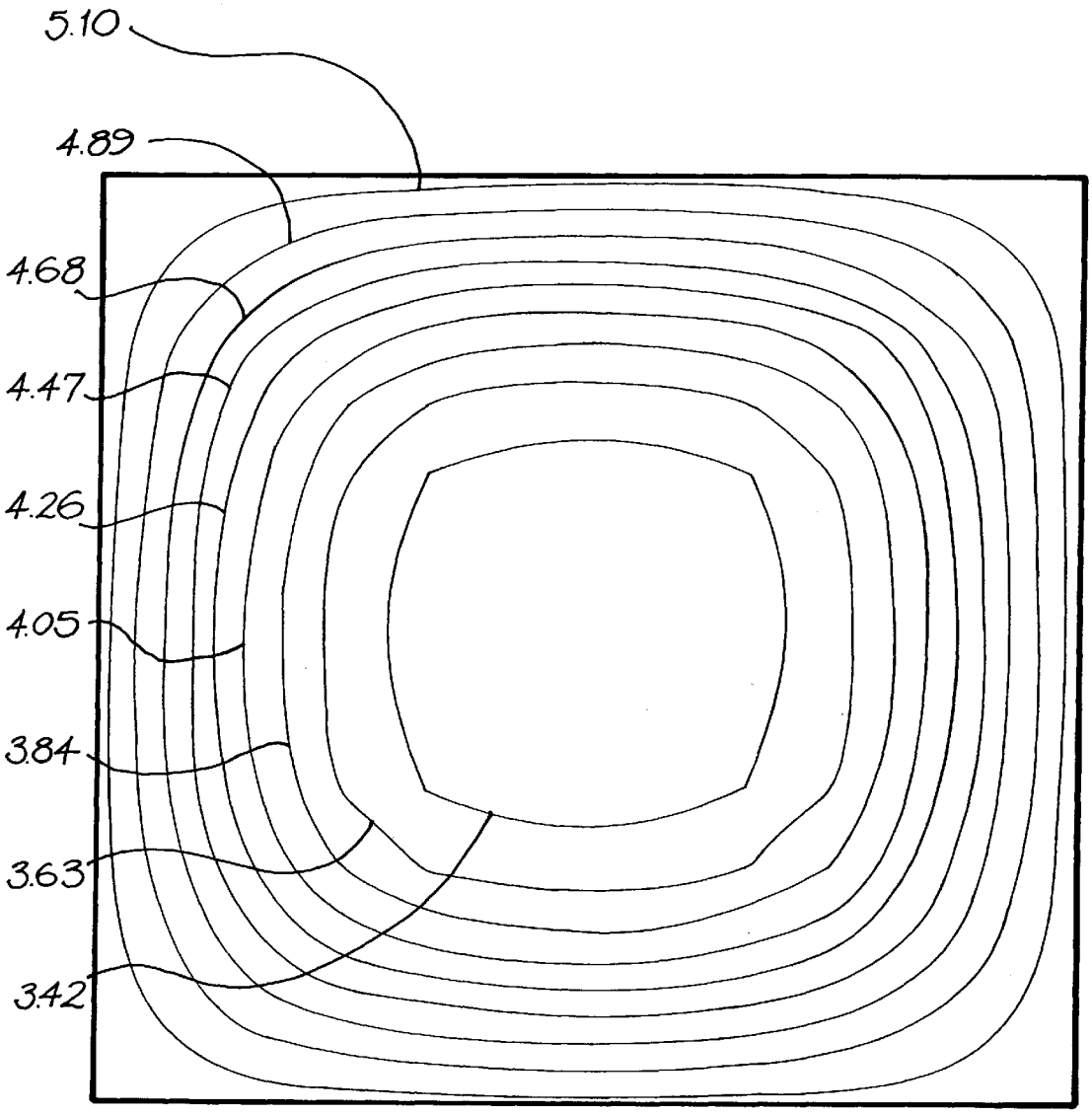
FIG. 24 is a graphical representation of coolant temperature profiles inside a micro channel having an aspect ratio of 1:1.

FIG. 18 shows temperature contours within a channel of a finned insulating heat exchanger having an aspect ratio of 3.4:1 on the hot side of a heat pump, the heat flux being 40,000 $W/m^2$, inlet fluid temperature 27° C., flow rate 1 l/min with pure water coolant.

The critical feature of the temperature profile is the difference in temperature between the fluid close to the heated surface and the bulk of the fluid. It can be seen that this difference is significantly less for the heat exchanger shown in FIG. 17 than for the earlier design involving plastic fins or partitions shown in FIG. 18 which has a temperature gradient of 30.7° C. This indicates that the heat exchanger has largely solved the problem of the earlier design where the bulk of the coolant remained effectively unheated during its passage through the heat exchanger.

The heat dissipation capability of the narrow channel heat exchanger is primarily dependent on the conduction of heat along the walls of the channel and the convective heat transfer in the fluid at the channel walls. The combination of these two aspects determine the overall thermal resistance of the heat transfer process within the heat exchanger. Increased channel wall thickness and enhanced convective mechanism resulting from higher fluid velocities act favourably to reduce the overall thermal resistance in the heat exchanger.

Using a computational heat and fluid flow model, the heat transfer performance of the narrow channel heat exchanger is evaluated and optimised to obtain the most effective flow arrangement. For a given fluid mass flow rate and a fixed external heat flux applied to the top surface of the channel, the variation of fluid temperature contours with channel aspect ratio is illustrated in FIGS. 19 to 24.

It is evident that, as the channel aspect ratio increases (narrow channel), heat tends to penetrate deeper into the fluid passage reducing the difference between the highest and the lowest temperatures indicated in the fluid. Consequently, the fluid temperature distribution becomes more uniform in these channels. Thus, the narrow channels tend to exhibit a lower thermal resistance (or a higher thermal conductance) for heat flow to the fluid than the equivalent channels of small aspect ratios. The mechanisms of convective heat transfer enhancement in narrow channels and the extended area available for heat dissipation are the primary factors that contribute to this behaviour. High thermal conductivity of channel wall also effectively helps to achieve further improvements in heat transfer performance.

While the heat transfer capability improves with the increased aspect ratio, higher fluid pumping power requirements in narrow channels determine the upper limit of the useable range of aspect ratio for these channels. The range of aspect ratios found to be useful range from 4:1 to 15:1. When applied to a typical thermoelectric module which has surface dimensions of 40 mm×40 mm the number of channels may range from a minimum of 10 up to a maximum of 100.

A thermally conductive base plate is integrated with the fins to ensure minimal thermal resistance to heat flow. This base plate could act as the wall of an electronic heat pump, replacing the low conductivity ceramic presently used.

Careful control of thermal contact resistance between heat exchanger base plate and electronic heat pump is critical to achieving high thermodynamic efficiency of the system. The extremely low thermal conductivity of air (approximately 0.03 W/m*K) causes a high thermal impedance to be generated by any gap exceeding approximately 5 micrometres thickness. Consequently, both contacting surfaces of the heat pump and the heat exchanger must be flat to within approximately 1 micrometres tolerance to ensure a satisfactorily small contact gap. In low-cost manufacturing, such a small tolerance may be difficult to achieve so a solder joint may become necessary. The solder should have the highest practical level of thermal conductivity and a low melting point to facilitate the joining of the heat exchanger to the surface of the electronic heat pump, without damage to the latter.

The overall size of the heat exchanger is not limited to the surface area of the electronic heat pump. It can be made larger and because it is of high conductivity metal there will be minimal thermal resistance to the flow of heat. This enables an even greater expansion of the surface area for heat exchange to a liquid coolant through channels.

Other high conductivity devices, such as heat pipes, can be used in conjunction with the heat exchanger in order to enlarge the potential contact area or to transport the heat load to a more convenient location for mounting of the heat exchanger.

In order to appreciate the enhanced mechanism of heat transfer provided by the invention for high heat flux thermoelectric cooling applications, it is appropriate to review the development of heat transfer techniques.

In cooling of electronic equipment, traditional heat transfer mechanisms such as natural convection, forced convection and boiling have been effectively applied and tested. In the past decade, requirement for operating heat flux levels of these devices has been steadily increasing from around 50 $W/cm^2$ to 100 $W/cm^2$. Even with various enhancement methods, conventional heat transfer equipment is inadequate for most of these applications owing to their poor thermal characteristics and large physical size. The quest for miniaturisation in modern devices has crated an urgent need for development of high heat flux modules and improved understanding of heat transfer phenomena.

The prior art includes many heat transfer mechanisms that generally yield significantly high levels of heat fluxes. Some such flow arrangements with inherently high rates of heat transfer are jet impingement cooling, interrupted jet cooling and heat transfer in very narrow passages or microchannels.

In jet cooling techniques, the thermal and hydrodynamic boundary layers associated with the flow are continuously changed causing a reduction in thermal resistance at the liquid-wall interface. Hence, the heat dissipation to the fluid is improved. However, due to high jet flow velocity requirements and wetting of surfaces, applications are limited to specific cases of heat transfer situations. In a microchannel heat exchanger, a cooling liquid is forced through narrow channels (width of the order of 0.05 to 5 mm) built in a plate attached to an electronic device to carry away the heat generated during its operation. Through experimental methods, it has been established that, the heat transfer coefficients in microchannel flow tends to be about 60 times higher than those of conventional macroscale flow passages. Microchannel heat transfer is considered to have great potential for providing high rates of cooling necessary for modern instruments with high powered circuitry in applications such as Micro-Electric-Mechanical-Systems, high-speed computers, biomedical diagnostic probes, lasers and precision manufacturing.

Various studies indicate that the microchannel flow and heat transfer phenomena cannot be explained by conventional theories of transport mechanisms. For instance, the transition from laminar flow to turbulent flow starts much earlier (e.g., from Re=300); the correlations between the friction factor and the Reynold number for microchannel flow are very different from that in classical theory of fluid mechanics; the apparent viscosity and the friction factor of a liquid flowing through a microchannel may be several times higher than that in the conventional theories. These special characteristics of flows and heat transfer in microchannels are the results of micron-scale channel size and, the interfacial electrokinetic and surface roughness effects near the solid-liquid interface. High convective heat flux rates achievable in microchannel flow is attributed to these vastly different flow phenomena that occur in narrow passages.

High rate of heat flux encountered in microchannels allow a compact microchannel heat sink system to have lower thermal resistance and to work under high cooling load situations. The microchannel heat sink technology is therefore increasingly being used in modem electronic packaging, high-speed computers and other related industries. The heat exchanger design of the thermo-electric cooling module attempts to harness possible heat transfer enhancement in flow through narrow passages.

The preferred heat exchange is made of metal of high thermal conductivity and has several narrow rectangular passages through which the cooling liquid flows. High thermal conductivity helps to spread heat flux evenly around the channel walls that are in contact with the liquid, thereby increasing the effective area heat transfer to the fluid. Due to special flow characteristics in narrow passages as in microchannels, high heat transfer rates are present in the flow. The developing nature of the flow through the passage further contributes to the heat transfer augmentation. The combined effect of all these mechanisms gives rise to significantly low thermal resistance between the thermoelectric module attached to the heat exchanger and the cooling fluid than previous designs of heat exchangers for similar applications.

What is claimed is:

1. A heat exchanger for an electronic refrigerating heat pump that has a hot side and a cold side, the heat exchanger comprising:

a thermally conductive base having a first surface and a second surface, the second surface being obverse to the first surface;

a thermally conductive cover spaced apart from the base;

a plurality of thermally conductive walls between the base and the cover;

a plurality of closed narrow channels defined between adjacent walls, the base, and the cover through which a heat transfer liquid flows when the heat exchanger is in use;

wherein each narrow channel further comprises:

an inlet end of each narrow channel;

an outlet end of each narrow channel;

a width W of each narrow channel;

a height H of each narrow channel;

wherein the width W of each narrow channel is between about 0.1 mm and about 1.0 mm and the ratio of channel height H to channel width W is between about 4:1 to about 15:1; and wherein the flow of the heat transfer liquid through the heat exchanger only occurs through the closed narrow channels from the inlet end to the outlet end.

2. The heat exchanger of claim 1, further comprising:

a liquid inlet to the heat exchanger in communication with the inlet end of each narrow channel; and a liquid outlet from the heat exchanger in communication with the outlet end of each narrow channel.

3. The heat exchanger of claim 1, wherein each closed narrow channel further comprises:

a portion of the second surface of the base; and a portion of the cover disposed over a top of the adjacent walls.

4. The heat exchanger of claim 1, further comprising a manifold, the manifold comprising:

flat plate, two side walls, and two end walls defining an enclosure for receiving the heat exchanger;

an inlet port for receiving a liquid;

an inlet channel extending substantially perpendicular to the narrow channels from the inlet port to at least a furthest narrow channel from the inlet port to evenly distribute a flow of the liquid between the plurality of narrow channels;

an outlet port for discharging the liquid, the outlet port being located at a diagonal opposite end of the manifold from the inlet port;

an outlet channel extending substantially perpendicular to the narrow channels from the outlet port to at least a furthest narrow channel from the outlet port to allow an even distribution a flow of the liquid from between the plurality of narrow channels; and wherein the fluid input and output channels are parallel and defining there between a central cavity for situating the plurality of walls and narrow channels.

5. The heat exchanger of claim 4, wherein the flat plate of the manifold comprises the cover, the side walls of the manifold comprise outer side walls of the outer most narrow channels, and the end walls of the manifold comprise end walls of the inlet and outlet channels.

6. The heat exchanger of claim 4, wherein the cover further comprises a resilient polymeric sheet interposed between the manifold and the heat exchanger walls.

7. The heat exchanger of claim 4, wherein the base is in a sealing relationship with the central cavity.

8. The heat exchanger according to claim 1, wherein the walls are integral with the base and further comprising end walls that are constituted by a portion of the base.

9. The heat exchanger according to claim 1, wherein the walls are soldered to the base and further comprising end walls that are constituted by a portion of the base.

10. The heat exchanger according to claim 1, wherein the walls are formed by folding a continuous piece of thermally conductive material.

11. The heat exchanger according to claim 10, wherein the walls are soldered to the base and to the cover overlying the folded piece of thermally conductive material.

12. The heat exchanger according to claim 1, wherein the walls are integral with the cover and further comprising end walls that are constituted by a portion of the cover.

13. The heat exchanger according to claim 1, wherein the walls are soldered to the cover and further comprising end walls that are constituted by a portion of the cover.

14. The heat exchanger according to claim 1, wherein the height H of each closed narrow channel is less than about 10 mm.

15. The heat exchanger according to claim 1, wherein the base and cover are in a parallel and spaced apart relationship, wherein the plurality of thermally conductive walls are formed by a continuous piece of folded corrugated metal member disposed between the base and the cover, the folded corrugated metal member comprising top ends, bottom ends, and tapered sidewalls defining the plurality of closed narrow channels, wherein the top ends are attached to the cover and the bottom ends are attached to the base to form the closed narrow channels.

16. A heat exchanger for use with a heat exchanger module comprising one or more heat exchangers and an electronic heat pump in combination, each heat exchanger comprising:

a thermally conductive base having a first surface and a second surface;

a thermally conductive cover spaced apart from the base;

the first surface being substantially flat and adapted to make intimate surface contact with a surface of the electronic heat pump; and the second surface being obverse to the first surface and supporting an array of thermally conductive walls, adjacent walls defining there between a plurality of closed micro-channels between the base and the cover;

wherein a flow of a heat transfer liquid only occurs through the micro-channels;

wherein dimensions of the micro-channels, comprising a height H and a width W, are optimized so that flow exists predominately in the developing region as the liquid flows through the micro-channels;

an aspect ratio defined by the height H to width W of the micro-channels, the aspect ratio being between about 4:1 and about 15:1;

wherein the thermal resistance of the micro-channels is reduced to about 0.03° C./W by:

providing thermally conductive materials to spread heat flux evenly around the micro-channel walls that are in contact with the liquid to increase the effective area of heat transfer between the heat exchanger and the liquid; and providing narrow micro-channels to increase the aspect ratio to affect the flow characteristics of the liquid flowing through the micro-channels to further increase heat transfer between the heat exchanger and the liquid.

17. The hear exchanger according to claim 1, wherein the plurality of thermally conductive walls further comprise tapered side walls formed from a folded sheet of metal defining alternating narrow channels, wherein e direction of the side wall taper of each narrow channel is opposite to that of the immediately adjacent narrow channels.

* * * * *

UNITED STATES PATENT AND TRADEMARK OFFICE

CERTIFICATE OF CORRECTION

PATENT NO. : 6,446,442 B1
DATED : September 10, 2002
INVENTOR(S) : Andrew W. Batchelor et al.

It is certified that error appears in the above-identified patent and that said Letters Patent is hereby corrected as shown below:

Column 1,
Line 21, delete "a" and insert -- an -- thereafter;

Column 3,
Line 8, insert -- a -- before "portion";
Line 24, delete "10:1." and insert -- 10:1 -- therefor;

Column 5,
Line 19, delete "If" and insert -- In -- therefor;

Column 6,
Line 6, delete "5" after "be";

Column 7,
Line 40, insert -- one -- before "embodiment";

Column 12,
Line 41, delete "e" and insert -- the -- therefor.

Signed and Sealed this

Eleventh Day of February, 2003

JAMES E. ROGAN
*Director of the United States Patent and Trademark Office*